United States Patent [19]

Davies

[11] Patent Number: 4,696,385

[45] Date of Patent: Sep. 29, 1987

[54] ELECTRONIC COIN DETECTION APPARATUS

[75] Inventor: Ronald C. Davies, South Wales, United Kingdom

[73] Assignee: Digital Products Corporation, Fort Lauderdale, Fla.

[21] Appl. No.: 617,334

[22] Filed: Jun. 5, 1984

[51] Int. Cl.[4] ..... G07D 5/08

[52] U.S. Cl. ..... 194/319; 194/328

[58] Field of Search ..... 194/97 A, 99, 100 A, 194/100 R, 239, 317, 318, 319, 328

[56] References Cited

U.S. PATENT DOCUMENTS

| | | | |
|---|---|---|---|
| 3,921,003 | 11/1975 | Greene | 194/97 A X |
| 4,089,400 | 5/1978 | Gregory | 194/97 A |
| 4,286,703 | 9/1981 | Schuller et al. | 194/100 A |
| 4,354,587 | 10/1982 | Davies | 194/100 A |
| 4,385,684 | 5/1983 | Sugimoto et al. | 194/100 A |
| 4,483,431 | 11/1984 | Pratt | 194/97 A |
| 4,577,744 | 3/1986 | Doucet | 194/318 |

FOREIGN PATENT DOCUMENTS

| | | | |
|---|---|---|---|
| 2121579 | 12/1983 | United Kingdom | 194/317 |

*Primary Examiner*—F. J. Bartuska

*Attorney, Agent, or Firm*—Lerner, David, Littenberg, Krumholz & Mentlik

[57] ABSTRACT

Electronic coin or token detector apparatus is provided in accordance with the teachings of the present invention wherein a predetermined parameter of a coin under test is measured to determine genuineness and surface reflectivity is tested to insure a selected threshold level is present. The coin under test is treated as authentic only if both conditions are satisfied.

12 Claims, 2 Drawing Figures

ELECTRONIC COIN DETECTION APPARATUS

BACKGROUND OF THE INVENTION

The present invention relates to coin detectors and, more particularly, to electronic coin acceptors which act to discriminate between genuine and non-authentic coins for a predetermined denomination based upon measurable characteristics of the coins tested.

Vending and gaming machines accepting coins in return for products or services are commonplace today. In such machines, each coin inserted is typically inspected and evaluated for authenticity in a predetermined manner. Thereafter, the coin is accepted or rejected based upon the results of such evaluation and credit and products and/or services are provided to the consumer in an amount corresponding to the value of the coins accepted.

Coin evaluation has heretofore typically been accomplished by various mechanical and/or electronic devices employing a myriad of inspection or measurement techniques. In recent years electronic testors have been found to be preferable over merely mechanical devices and are now the more common in industry use. One preferred form of electronic coin detection apparatus is disclosed in U.S. Pat. No. 4,354,587, as issued to Ronald C. Davis on Oct. 19, 1982 and assigned to Third Wave Electronics Co., the assignee of the instant invention. The device disclosed in U.S. Pat. No. 4,354,587 operates on the principle that a metallic coin, passing through a magnetic field of an RF oscillator coil, will create eddy current losses. The magnitude of this loss is dependent upon the mass and conductivity of the coin under test. Circuitry is provided to measure the amount of the eddy current loss, and if the loss falls within certain narrow limits, the coin is determined to be valid. Upon detection of a valid coin, appropriate coin acceptance may be performed with the value of the accepted coin being credited to the consumer. A coin exhibiting losses outside predefined limits is considered to be invalid and is rejected. The device is highly advantageous in single denomination applications since it is fast and accurate in operation and its simplified electronic structure is compact, not subject to wear and relatively inexpensive.

The accuracy of the coin acceptor apparatus disclosed in U.S. Pat. No. 4,354,587 has been determined to be somewhat dependent upon the value of the coin for which a particular acceptor is designed. For example, very few slugs or foreign coins can successfully mimic the characteristics of the U.S. quarter. Hence, for U.S. quarters the accuracy of the aforesaid coin acceptor is considered excellent. However, it appears that the Eisenhower silver dollar is susceptible to slugging since it can be mimicked by certain washers or slugs consisting of a lead/zinc mixture having similar mass and conductivity characteristics. Since these content characteristics are employed by the coin acceptor apparatus disclosed in U.S. Pat. No. 4,354,587 as a basis for its discrimination decisions, it has been found that coin acceptors designed for Eisenhower silver dollars can sometimes be defeated by slugs of this type.

It has been found that the accuracy of coin acceptor apparatus employing the electrical, magnetic or mechanical characteristics of a coin for purposes of determining genuineness may be markedly increased by additionally testing the reflection characteristics exhibited thereby. This occurs since the very materials employed to provide a slug with appropriate electrical, magnetic or mechanical characteristics will generally impart an overall cast to the slug which causes marked differences in reflectivity between a valid coin and a slug having such appropriate electrical, magnetic or mechanical characteristics. Furthermore, those marked differences in reflectivity may be advantageously relied upon to enhance the accuracy manifested by coin detectors, and under certain circumstances, be employed to configure a coin acceptor per se.

It is therefore an object of the present invention to provide improved coin detector apparatus.

It is an additional object of the present invention to provide coin detector apparatus which tests for coin validity based upon the surface reflectivity of a coin under test.

It is still a further object of the present invention to provide coin detector apparatus providing a two-tier test for validity of a coin, including a first test for content and a second test for reflectivity of the coin under test.

SUMMARY OF THE INVENTION

In accordance with the teachings of the present invention, coin detector apparatus is provided wherein a predetermined parameter of a coin under test is measured to determine genuineness and surface reflectivity is tested to insure a selected threshold level is present. The coin under test is treated as authentic only if both conditions are satisfied.

DESCRIPTION OF THE INVENTION

Figure 1:
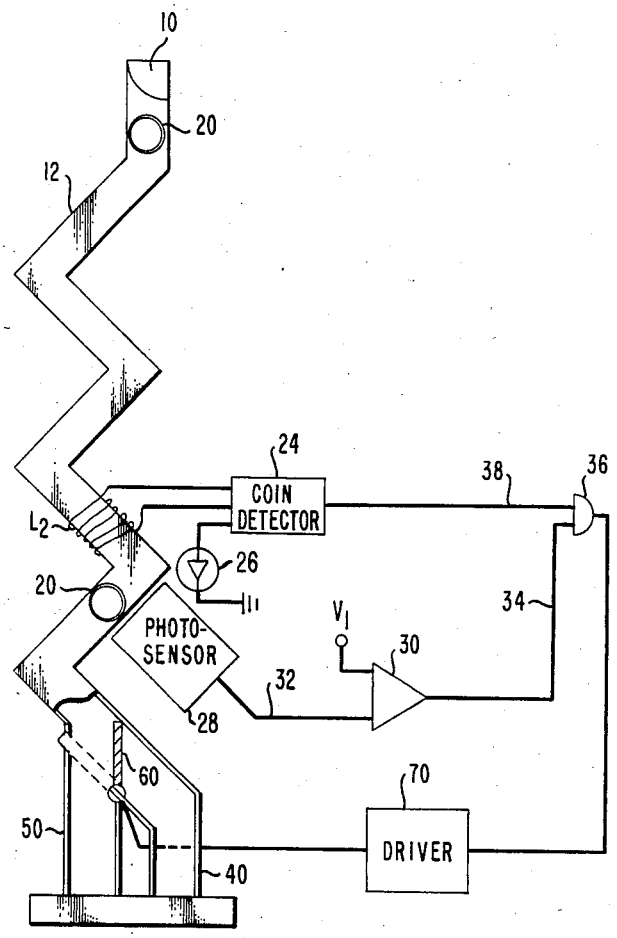
FIG. 1 is a schematic representation of coin detector apparatus according to the present invention.

The coin detector apparatus according to the present invention, as shown schematically in FIG. 1, may be embodied in gaming or vending apparatus of any type or any other form of equipment wherein entry of a valid coin by a user serves as a predicate to the operation thereof. The apparatus illustrated in FIG. 1 includes a coin slot 10 and a chute 12 for receiving a coin 20 of a selected type. The chut 12 conveys a deposited coin 20 past a content sensor 24 of the type disclosed in U.S. Pat. No. 4,354,587 including a sensing coil $L_2$. Following the content sensor 24, according to the invention, is provided a reflectivity sensor arrangement comprising a source of radiation 26, a radiation detector 28 and a level detector 30. The chute 12 leads to a valid coin acceptance reservoir 40 and a coin return or rejection chamber 50. Access to the valid coin reservoir 40 and the rejection chamber 50 is controlled by a pivotably mounted plate 60 whose position is controlled by a driver 70. Any suitable acceptance-rejection mechanism well known to those of ordinary skill in the art may be employed, and pivotably mounted plate 60 and driver 70 may take the form of a solenoid-operated armature mechanism.

The exemplary reflectivity sensing arrangement shown in FIG. 1 includes a source of radiation 26 disposed adjacent to the path of the coin 20 being conveyed within the chute 12. The radiation source 26 may take the conventional form of a light-emitting diode and is positioned to direct radiation toward a surface of a coin 20 passing along the chute. Alternatively, an infrared light-emitting diode may be employed as the same renders the resulting apparatus less subject to ambient light. A radiation receiver or detector 28, which may take the conventional form of a phototransistor, with a black filter if infrared is employed, and is disposed adjacent to the chute in position to receive radiation reflected from the coin as it passes through a predetermined portion of the chute 12.

The radiation detector 28 has its output connected through conductor 32 to one input of the level detector 30, which may take the conventional form of a comparator, having a second input biased at a selected level representing a threshold level of radiation which must be received from a valid coin. The output of the comparator 30 is connected through conductor 34 to one input of a conventional AND gate 36 which provides a high level at the output thereof only when all of the inputs thereto are high. A second input to AND gate 36 is provided through conductor 38 from the output of the coin detector 24. The ouput of AND gate 36 is connected through conductor 39 to the driver 70. The driver 70 may comprise a conventional driver solenoid or the like and acts to operate the plate 60 to drop the coin into the valid coin reservoir 40. If a deposited coin does not result in an output from the coin detector 24 and the comparator 30, it is treated as not valid and will drop into the rejection chamber 50 since the pivotable plate 60 is not actuated.

It is noted that the source of infrared radiation 26 and the radiation detector 28 may be of any suitable type and are properly housed, and the threshold on comparator 30 is properly set, so that spurious ambient radiation will not cause the faulty operation or activation thereof.

In operation of the system of FIG. 1, the circuit sensitivity of the radiation detector 28 is tested for a very bright, highly reflective coin and for a less reflective, worn coin and an average setting $V_1$ for the comparator 30 is determined. Alternatively, one-half of the reflectivity found for a relatively new coin may be employed for setting the value $V_1$.

In operation of the embodiment of the invention shown in FIG. 1, the insertion of a coin in the coin chute 10 causes coin sensor 24 to read the same as it traverses the portion of the coin chute 12 at which the coil $L_2$ is disposed. A valid coin causes the coin sensor 24 to generate an output voltage in precisely the same manner described in U.S. Pat. No. 4,354,587. When an appropriate output voltage is generated by the coin detector 24, the radiation source 26 is enabled and a high is placed on conductor 38 which serves as one input to the AND gate 36. Once source 26 is enabled and the inserted coin has traversed to a portion of the chute in light communication with source 26 and the radiation detector 24, the reflectivity of the coin inserted is measured. Thus, if the detector receives a required amount of radiation from the coin to produce an output on conductor 32 exceeding the $V_1$ threshold set, the comparator 30 will provide an output on conductor 34. Since the output on conductor 38 from coin sensor 24 is still high, the output of AND gate 36 will go high. This will cause driver 70 to actuate plate 60 to a position to accept the coin.

If the coin sensor 24, which tests for content characteristics, does not sense the presence of a valid coin 20, then radiation source 26 is not enabled nor does the input to AND gate 36 on conductor 38 go high. Under these conditions, the driver 70 is not operated, plate 60 is not displaced, and the coin inserted falls into the rejection chute 50. Conversely, if coin sensor 24 does detect the presence of a coin having valid content parameters, but such coin fails to reflect sufficient light from source 26 onto the photosensor 28 due to its overall cast or the like, rejection will again occur since no enabling level will be provided to AND gate 36 on conductor 34.

Figure 2:
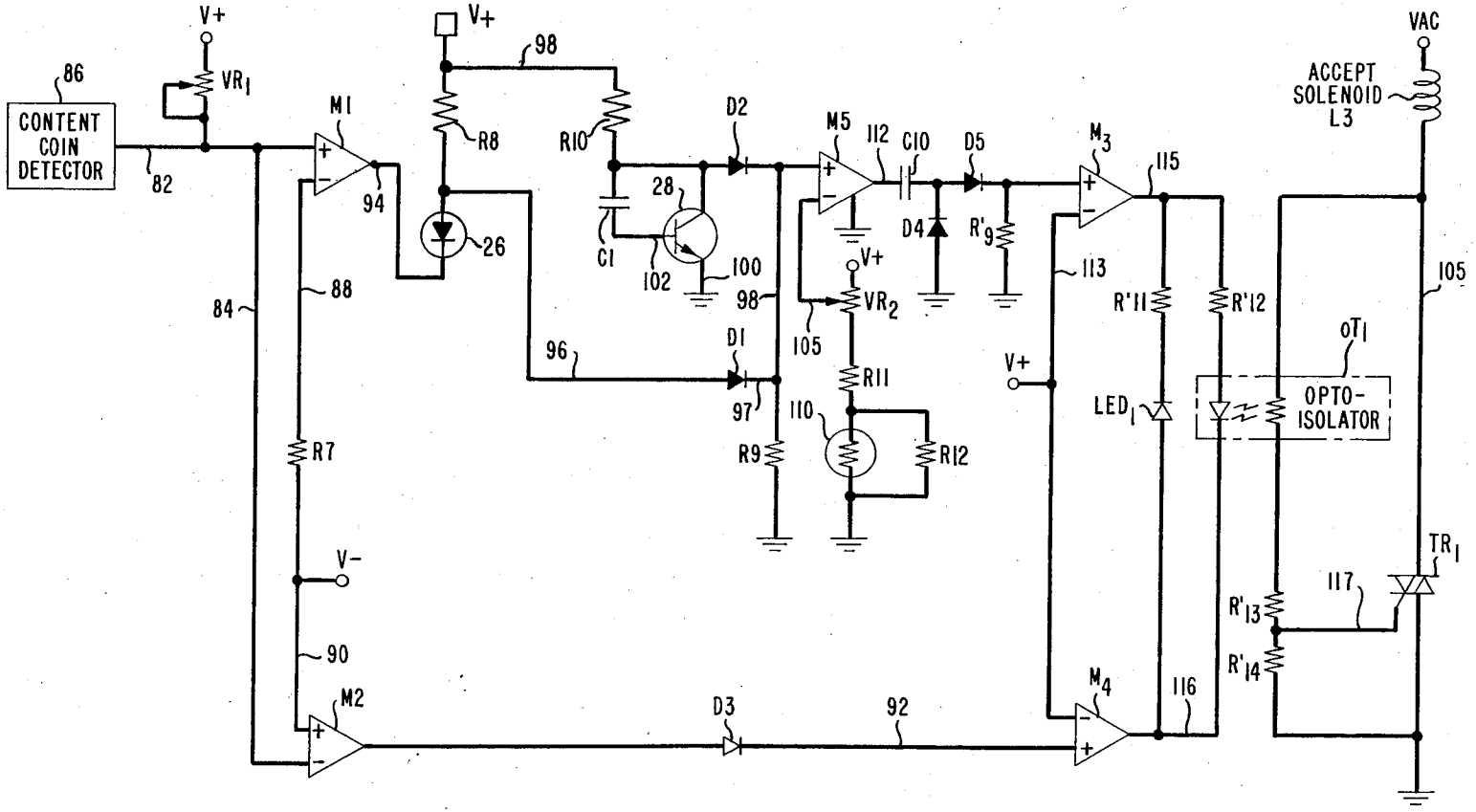
FIG. 2 is a schematic representation of a detailed electronic circuit for practicing the invention.

Referring now to FIG. 2, there is shown a detailed schematic of a preferred embodiment of the present invention. The preferred embodiment of the invention illustrated in FIG. 2 comprises comparators $M_1$–$M_5$, radiation source 26, photosensor 28 and a triac driver $TR_1$. The detailed schematic of the invention illustrated in FIG. 2 draws directly, and is an improvement upon, the coin acceptor or rejector disclosed in U.S. Pat. No. 4,354,587 and, for this reason, corresponding circuitry described and illustrated in the patent is shown in a corresponding manner in FIG. 2, and portions thereof which are not needed for a detailed appreciation of the instant invention have only been illustrated in a generalized manner.

Thus, those of ordinary skill in the art may wish to make reference to the disclosure of U.S. Pat. No. 4,354,587, whose disclosure is hereby incorporated by reference herein, for additional details as to subject matter only generally shown in FIG. 2. In this regard, reference should be made to FIGS. 5 and 6 of U.S. Pat. No. 4,354,587, as well as the accompanying description thereof.

The comparators $M_1$ and $M_2$ may take the conventional form of this well-known class of device as readily available in the marketplace. Furthermore, the comparators $M_1$ and $M_2$ illustrated in FIG. 2 correspond in form, function and circuit connection to the comparators $M_1$ and $M_2$ illustrated in FIG. 6 of U.S. Pat. No. 4,354,587 and are provided with a bias network generally indicated by the source of voltage V− and the resistor $R_7$ so that a fixed reference voltage is applied to complimentary inputs of the comparators $M_1$ and $M_2$. The remainining complimentary inputs of the comparators $M_1$ and $M_2$ are connected through the conductors 82 and 84 to the output of the content coin detector 86.

The content coin detector 86, as now will be appreciated by those of ordinary skill in the art, takes the form of the portion of the coin detector illustrated in FIG. 5 of U.S. Pat. No. 4,354,587 whose principal components involve an RF choke $L_1$, a sensing coil $L_2$, a field effect transistor $FET_1$, as well as the remaining components and voltages connected thereto in FIG. 5 and the additional portions shown in FIG. 6 which have not been reproduced in FIG. 2 of the instant application. Thus, those of ordinary skill in the art will appreciate that when a coin is sensed by the content coin detector 86, an output will be produced therefrom on conductor 82 in the form of a negative pulse whose magnitude will vary as a function of the conductive characteristics of the item being deposited. Therefore, if a genuine coin is inserted, the content coin detector 86 will, in accordance with the teachings of U.S. Pat. No. 4,354,587, produce a negative pulse whose magnitude will reside within a fixing range which, in the case of the example of a U.S. quarter set forth therein, will approximate 100 mv. If the coin is not genuine, the coin detector is set to detect a negative going signal outside of the predetermined range. For instance, if the coin or slug inserted is principally composed of copper, brass, aluminum and/or lead, when passed through the content coin detector 86, a negative going signal much smaller than 100 mv will be produced. Conversely, when coins having a high ferrous content are employed, signals having a much larger negative magnitude than that of a genuine coin are produced.

Further, as is also described in U.S. Pat. No. 4,354,587, it is a characteristic of the comparators $M_1$ and $M_2$, as well as the remaining comparators $M_3$–$M_5$ set forth in FIG. 2, that whenever the plus input of the gate is more positive than the minus input thereof, the output will be high; and conversely, when the minus input thereto exceeds the plus input, the output will be low. The comparators $M_1$ and $M_2$ are further biased in a complimentary manner so that the precise range of the negative going voltage excursion output by the content coin detector 86 is established for a valid coin. Thus, for instance, if it is assumed for purposes of discussion that a valid Eisenhower silver dollar will cause the output of the content coin detector 86 to produce a negative pulse having a value of −250 mv and that a 60 mv range is to be established, the variable resistor $VR_1$, which is connected from the potential source V+ to the conductor 82, is set to establish a 250 mv level above the reference and to apply such level to the plus input of the comparator $M_1$ through the conductor 82, and similarly to the negative input of the comparator $M_2$ through the conductor 84.

The 60 mv range for which a coin is to be treated as valid is then established at the remaining complimentary inputs of the comparators $M_1$ and $M_2$ by applying a 30 mv potential with respect to the circuit reference to the negative input of comparator $M_1$ which is connected to the potential source V− through the conductor 88 and the resistor $R_7$, while a −30 mv level with respect to the circuit reference is applied to the positive input of the comparator $M_2$ from the voltage supply V− which is connected thereto through the conductor 90. Obviously, as will be apparent to those of ordinary skill in the art, additional biasing arrangements for the comparators $M_1$ and $M_2$ so as to utilize only a single voltage supply V+ may be employed.

Under these conditions, as will be readily appreciated by those of ordinary skill in the art, under quiescent conditions the outputs of the comparator $M_1$ will be high while the output of the comparator $M_2$ will normally be low since each of the comparators $M_1$–$M_5$ used herein acts in the normal manner to produce an output corresponding to a positive level if the positive input thereto is at a greater positive potential than its negative input, and conversely, to produce a negative output whenever the negative input thereto is at a greater positive level than the positive level thereto.

For the biasing conditions set forth, it will be appreciated that whenever the content coin detector 86 produces a negative going pulse within the range determined for a valid coin, in this case an Eisenhower silver dollar, the magnitude of the pulse produced will fall within a range of 220 to 280 mv and this pulse will be produced for the duration of the time that the Eisenhower silver dollar is within the sensing coil $L_2$. During the presence of such a pulse on conductor 82, the output of the comparator $M_1$ which is normally high will go low as the potential at the negative input thereto on conductor 88 will be greater than the potential at the positive input thereto by a value in the range of from 0 to 30 mv. The output of the comparator $M_2$, however, will stay low, since during the presence of a negative going pulse on conductor 82 having a magnitude of from 220 to 280 mv, the negative potential applied to the positive input thereof on conductor 90 will be more negative than that present at the negative input thereto by an absolute value extending between 0 to 30 mv.

Should, however, a coin or slug composed chiefly of copper, brass, aluminum or lead be inserted, then the output of the content coin detector will take the form of a negative going pulse having a value substantially below 220 mv. Under these conditions, both the comparators $M_1$ and $M_2$ will remain in their quiescent states, i.e., a high at the output of comparator $M_1$ and a low at the output of comparator $M_2$, since in each case the resulting level on conductor 82 will be insufficient to offset the bias on conductors 82 and 84 applied by the resistor $VR_1$ to an extent sufficient to change the quiescent state of the comparators $M_1$ and $M_2$. If, however, a steel slug or coin is employed, the output of the content coin detector 86 supplied to the conductor 82 will exceed the 280 mv level established for valid coins while such a slug or coin is traversing the sensing coil $L_2$. Under these conditions, the output of the comparator $M_1$ will again switch from high to low; however, the comparator $M_2$ will also change from its normal low state to a high state since the negative 30 mv level applied to the positive input thereto through conductor 90 will be more positive than the resulting negative excursion present on the conductor 84.

The output of the comparator $M_2$ is connected through a diode $D_3$ at conductor 92 to the positive input of the comparator $M_4$ to form a leading edge detector in precisely the same manner described in U.S. Pat. No. 4,354,587. The output of the comparator $M_1$ is connected through conductor 94 to the radiation source 26 which, as shown, may take the form of a conventional light-emitting diode. The anode of the light-emitting diode 26 is connected through a resistor $R_8$ to a source of potential V+ and through conductor 96, diode $D_1$, conductor 97 and resistor $R_9$ to ground. The resistor $R_9$ is also connected through conductor 98 to the positive input of comparator $M_5$ and to the cathode of diode $D_2$. The resistor $R_8$ is also connected, as shown in FIG. 2, through a conductor 98 and resistor $R_{10}$ to the anode of diode $D_2$, the capacitor $C_1$ and the collector of the photodetector 28 which may take the form, as illustrated, of a phototransistor. The emitter of the phototransistor 28 is connected through conductor 100 to ground, while the base input thereof is connected to capacitor $C_1$ through the conductor 102.

The phototransistor 28 may take any of the conventional forms of this well-known class of device and acts to produce current proportional to the amount of light received thereby which, as will now be appreciated by those of ordinary skill in the art, corresponds to light emitted by the light-emitting diode 26 and reflected from the coin whose reflectivity is being tested. The purpose of the capacitor $C_1$ is to slow the response of the phototransistor 28 so that the output voltage across resistor $R_{10}$ is not effected by engravings or the like present on the coin under test. Because the response of phototransistor 28 is slowed by capacitor $C_1$, the output of the phototransistor will represent a time average response and hence will reflect the average reflectivity of the coin being tested. Those of ordinary skill in the art will appreciate that whenever the output of the comparator $M_1$ goes low, the light-emitting diode 26 will be illuminated as a result of the potential applied thereto from voltage source V+ through the resistor $R_8$. This will also serve, as will be readily appreciated by those of ordinary skill in the art, to back bias diode $D_1$, and hence, remove the clamping voltage applied to the positive input of the comparator $M_5$ through the conductor 98.

Whenever a coin under test is in a position in the chute to reflect light from the light-emitting diode 26 onto the phototransistor 28, the phototransistor 28 will produce a current proportional to the amount of received light. This current will develop a voltage across the load resistor $R_{10}$ which is applied to the positive input of the comparator $M_5$ through the diode $D_2$ which has now been forward biased.

The comparator $M_5$ may take precisely the same form of comparator device described in association with the comparators $M_1$ and $M_2$ and here functions, as will be appreciated by those of ordinary skill in the art, to compare the potential established as a result of reflected light received by the phototransistor 28 to a predetermined level established as appropriate for reflectivity from a valid coin. This is a result of the discovery that while certain slugs consisting of a lead/zinc mixture are capable of inducing the content coin detector 82 to produce a negative going pulse having a magnitude within a range normally produced by an Eisenhower silver dollar, the cast or coloration associated with such a slug will provide a valid parameter upon which slug rejection may be based.

The negative input to the comparator $M_5$ is connected through conductor 105 to the variable resistor $VR_2$ employed, as aforesaid, to establish a potential level on conductor 105 corresponding either to the average value of reflectivity obtained from a very bright, highly reflective coin and for a less reflective, worn coin, or alternately, to one-half the reflectivity found for a relatively new coin. The variable resistor $VR_2$ is connected to a source of potential V+, which may take the form of a 6 v source or the like, and to a resistor $R_{11}$ and a thermistor 110 connected to ground. The thermistor 110 is connected in parallel with a resistor $R_{12}$. The thermistor 110 may take any of the conventional forms of this well-known device and should exhibit a positive temperature coefficient. The function of the thermistor 110 is to provide temperature compensation for the voltage level applied to the comparator on conductor 105. This is necessitated due to the characteristics of the light-emitting diode 26 whose light output power typically decreases approximately 1 percent per degree centigrade temperature rise. This function may also be achieved by use of a diode connected intermediate the source of potential V+ and the variable resistor $VR_2$. Use of a diode to achieve temperature compensation by virtue of the anode to cathode potential drop is particularly useful when an infrared LED is employed as light source 26. The voltage level established by the variable resistor $R_2$ on conductor 105 is typically set to a value of 3 v at a temperature of 27° C. Those of ordinary skill in the art will appreciate that the comparator $M_5$ is normally in a positive output state since diode $D_1$ serves to clamp the positive input thereto to a higher positive level, normally about 5.3 v, than the voltage level normally applied to the conductor 105.

The output of the comparator $M_5$ connected to conductor 112 is thus normally high and will switch to a low condition only when two conditions are met. These conditions are that a metallic coin must be passing through the content coin detector 86 and its metallic content and size must satisfy the lower level threshold of the sensing circuit established by comparator $M_1$ which is, in effect, an eddy current loss sensing circuit. The second condition is that the reflectivity characteristic of the coin must satisfy the conditions established by the variable resistor or potentiometer $VR_2$ on the negative input to the comparator $M_5$ connected to conductor 105.

The output of the comparator $M_5$ is connected through conductor 112, capacitor $C_{10}$ and the diode $D_5$ to the positive input of the comparator $M_3$. The anode of the diode $D_5$ is connected to ground through the diode $D_4$, while the cathode thereof is connected to ground through the resistor $R'_9$. This circuit is precisely the same as that described in U.S. Pat. No. 4,354,587 wherein a prime designation has been provided in association with the resistor $R'_9$ so that corresponding reference indications, with the exception of prime notations, are provided throughout. As described in the patent, coupling of the positive input of the comparator $M_3$ through the components $D_4$, $D_5$, $C_{10}$ and $R'_9$ form a trailing edge detector which will trigger whenever the comparator $M_5$ exhibits a low to high transition. Typically, the trailing edge will occur at the end of a sequence of operation wherein the phototransistor 28 has been rendered conductive to cause the output of the comparator $M_5$ to go low, followed by a return of the output of the comparator $M_5$ to a high state when a valid coin has completed its transition past the photosensitive transistor 28 and the clamping potential is restored to the conductor 98 by diode $D_1$. This return to a positive state by the comparator $M_5$, which is associated with the trailing edge of the negative going pulse produced thereby, will be detected by the comparator $M_3$ which, due to the positive potential associated with the source V+ applied to the negative input terminal thereof on conductor 113, normally resides in a low output condition. However, when a low to high transition associated with a trailing edge is provided at the output of the comparator $M_5$, the comparator $M_3$ will go positive for a duration controlled by the timing circuit formed by the capacitor $C_{10}$ and the resistor $R'_9$. Typically, the time constant associated with the capacitor $C_{10}$ and the resistor $R'_9$ is of an order of approximately 120 milliseconds. The positive potential applied through the conductor 113 to the negative input of the comparator $M_3$ is also applied through this common conductor to the negative input of the comparator $M_4$.

The output of the comparator $M_3$ is connected through the conductor 115 and the bias resistor $R'_{12}$ to the anode portion of the opto-isolator $OT_1$, while the output of the comparator $M_4$ is connected through the conductor 116 to the cathode portion of the opto-isolator $OT_1$. The opto-isolator $OT_1$ may take any of the well-known forms of this conventional class of device and here acts in the conventional manner, as fully described in U.S. Pat. No. 4,354,587, to electrically isolate the DC and AC driver portion of the circuits disclosed herein. The opto-isolator is shunted by the light-emitting diode $LED_1$ and the resistor $R'_{11}$ to provide a visual indication by way of an illuminating of the light-emitting diode $LED_1$ whenever the output state of the comparator $M_3$ is low and the output state of the comparator $M_4$ is high to thus enable an adjustment of the sensitivity control provided by the variable resistance $VR_1$ for various types of coins. The output side of the opto-isolator $OT_1$ is connected, as illustrated in FIG. 2, through biasing resistors $R'_{13}$ and $R'_{14}$ to the gate electrode of the triac $TR_1$ through conductor 117. Thus, as will be readily appreciated by those of ordinary skill in the art, whenever the opto-isolator $OT_1$ is enabled, the triac $TR_1$ will be gated on, and hence, allow potential from the AC source (VAC) to flow through the accept solenoid $L_3$, the triac $TR_1$ to ground, to thus enable the accept solenoid $L_3$. The accept solenoid is arranged to actuate the pivoted plate 60, illustrated in FIG. 1, and place the same in a position so that a coin dropped into the chute 12, which has passed both the content and reflectivity tests imposed by the instant invention, is deposited within the valid coin reservoir 40, and additionally, the gaming device or vending machine associated therewith is placed in a condition to perform its function as a result of the insertion of a valid coin.

In operation of the embodiment illustrated in FIG. 2, it will be appreciated by those of ordinary skill in the art that a coin is disposed within the chute 12, illustrated in FIG. 1, and progresses therethrough past the sensing coil $L_2$ and subsequently to a position in light communication with the light-emitting diode 26 and the photosensor 28. Assuming for purposes of discussion that the embodiment of the invention has been properly adjusted for Eisenhower silver dollars, and that the coin under test is a genuine Eisenhower silver dollar, the content coin detector 86, illustrated in FIG. 2, will produce a negative pulse on conductor 82 having a magnitude of approximately −250 mv. The conductor 82 and the conductor 84 are normally biased through the variable resistor $VR_1$ and the potential supply V+ to approximately 250 mv above a circuit reference level which may typically reside at 3 v. Conversely, the negative input to the comparator $M_1$ connected to conductor 88 is normally biased to +30 mv above such circuit reference level, while the positive input to the comparator $M_2$ is biased to −30 mv below such circuit reference level to establish a content range for coins which are to be treated as valid for the reasons aforesaid.

Accordingly, when the content coin detector 86 produces a negative going pulse having a magnitude of 250 mv on the output conductor 82, or, in fact, any negative going pulse in the range of from 220 to 280mv for the acceptance range established above, the comparator $M_1$, which is normally in a high output condition, will be driven to a low output state as the bias level established at the negative input thereto will exceed the potential level on conductor 82 for the duration of the output of the content coin detector 86. Under these same input conditions, the comparator $M_2$ will remain in its normally low output state as the negative 30 mv bias established at the positive input thereto connected to conductor 90 will be less positive than the potential at the negative input thereto connected to conductor 84 which, under the conditions herein being discussed, will range for the duration of the pulse from approximately +30 mv to −30 mv. Hence, the comparator $M_2$ remains in the negative state. With the output of the comparator $M_2$ negative, the diode $D_3$ will be reversely biased, and hence, the comparator $M_4$ will remain in a negative state due to the bias provided thereto on conductor 113. This means that the cathode condition applied by the comparator $M_4$ through conductor 116 to the opto-isolator $OT_1$ is appropriate for conduction.

When the output of the comparator $M_1$ goes negative for the duration of the pulse produced by the content coin detector 86, a low will be provided on conductor 94. This will cause the light-emitting diode 26 to be illuminated due to the voltage flowing therethrough from the potential supply V+ and the resistor $R_8$. Additionally, upon illumination of the light-emitting diode 26, the diode $D_1$ will be reversely biased, and hence, remove the clamping voltage applied thereby to the positive input to comparator $M_5$ through the conductors 97 and 98. Thus, once the light-emitting diode 26 is enabled, the circuit is conditioned for the coin under test traversing to a portion of the chute in light communication with the photosensor 28 and the light-emitting diode 26.

Once this occurs, light reflected from the coin will be received by the phototransistor 28 which acts, as aforesaid, to produce a current proportional to the amount of light received. This current acts to develop a voltage across the collector voltage resistor $R_{10}$ which is coupled to the positive input of the comparator $M_5$ through the diode $D_2$ which became forward biased upon illumination of the light-emitting diode 26. As aforesaid, the capacitor $C_1$ acts to slow the response of the phototransistor 28 so that the output voltage across the load resistor $R_{10}$ is not effected by engravings or the like which may be present on the coin; however, the accuracy of the amount of light received from the coin is not effected. The potential level thus applied to the positive input of the comparator $M_5$ is compared to the positive potential established at the negative input to the comparator $M_5$ by the voltage level established by the variable resistor $VR_2$ and the temperature compensating thermistor 110. This voltage level is normally established at approximately 3 v so that unless the phototransistor 28 exhibits substantial current flow therethrough, the output of the comparator $M_5$ will reside in its normally high state.

Should the conduction of the phototransistor 28 drop the potential on the positive input to comparator $M_5$ below the value established by the variable resistor $VR_2$ on the negative input thereto, the output of the comparator $M_5$ connected to conductor 112 will go low. Those of ordinary skill in the art will now appreciate that this will only occur if a metallic coin has passed through the content coin detector 86 having a content and size which is sufficient to satisfy the low level threshold of the eddy current loss sensing circuit, and additionally, such coin has a reflectivity characteristic which is sufficient to satisfy the conditions established by the threshold set on the comparator $M_5$ by the variable resistor $VR_2$. When the output of the comparator $M_5$ goes low, the output of the comparator $M_3$ will remain in its low state due to the trailing edge detector circuit coupling this input to the comparator $M_3$.

When, however, the coin has passed the optical sensor 28 to thereby return the clamping voltage to the positive input of comparator $M_5$, the output thereof on conductor 112 will undergo a transition from low to high in association with the trailing edge of the pulse produced. This will cause the output of the comparator $M_5$ to go from low to high, as aforesaid.

When the output of the comparator $M_3$ goes high, the high level present on conductor 115, coupled with the low level on the output of the comparator $M_4$ connected to conductor 116, will cause current to flow through the opto-isolator $OT_1$ in a manner well known to those of ordinary skill in the art. This, in turn, will trigger the triac $TR_1$ and the gate electrode thereof connected to conductor 117 to cause voltage to flow from the source indicated as VAC to thereby actuate solenoid $L_3$. This causes the pivoted metal plate 60 to be displaced to its accept position, as indicated by the dashed lines in FIG. 1, whereupon the coin under test is placed in the accept reservoir 40. The accept solenoid $L_3$ will be maintained, under these conditions, in an actuated condition for approximately the 80 millisecond interval associated with the high output condition of the comparator $M_3$ which persists in a manner controlled by the capacitor $C_{10}$ and the resistor $R'_9$ for an interval of approximately 80 milliseconds. This interval is sufficient, as more fully explained in U.S. Pat. No. 4,354,587, to permit the coin in transit in chute 12 to pass between the location at which it is sensed and tested and the accepted coin reservoir 40 without being caught in the chute. Upon expiration of the 80 millisecond interval associated with the high output condition for the comparator $M_3$, the comparator $M_3$ will return to its normally low state whereupon the opto-isolator $OT_1$ is disabled and the accept solenoid $L_3$ de-energized.

If it is now assumed that a slug or washer formed of a lead/zinc mixture and capable of mimicking the electrical characteristics of an Eisenhower silver dollar is inserted into the coin slot 10, it will be seen that the content coin detector 86, illustrated in FIG. 2, will produce the same negative pulse on conductor 82 having an excursion of approximately 250 mv, as was produced for a genuine Eisenhower silver dollar. This means that the comparator $M_1$ will be switched from a high to a low state for the duration of the pulse while the output of the comparator $M_2$ will remain in its normal low state.

When the output of the comparator $M_1$ goes low, the light-emitting diode 26 will again be enabled and light therefrom will be reflected from the slug or washer under test onto the phototransistor 28. Under these conditions, however, the current flow through the phototransistor 28 will be insufficient to drop the voltage applied to the positive input of the comparator $M_5$ to a level such that it is exceeded by the voltage applied to conductor 105 by the variable resistor $VR_2$. This will occur due to the cast of the slug or washer being of wholly insufficient brightness to reflect sufficient light onto the phototransistor 28. Thus, under these circumstances, the output of the comparator $M_5$ on conductor 112 will not change, and hence, the output of comparator $M_3$ on conductor 115 will remain in a low state which is its normal condition. Hence, the opto-isolator $OT_1$ will not be enabled, and therefore, the accept solenoid $L_3$ will remain disabled so that the pivoted metal plate 60 remains in the position, illustrated in FIG. 1, whereupon the washer or slug is conveyed into the return or rejection chamber 50.

When a metallic coin is placed in the coin slot 10 which has insufficient metallic content or size to cause the content coin detector 86 to generate a negative going pulse having a magnitude at least equal to 220 mv, it will be seen that neither the comparator $M_1$ nor the comparator $M_2$ will change its output state. This occurs since the negative going pulse generated by the content coin detector 86 is wholly insufficient in magnitude to overcome the normal states associated with each of the comparators $M_1$ and $M_2$. Hence, the light-emitting diode 26 is never energized, the output conditions of comparators $M_5$ and $M_3$ do not change, and the opto-isolator $OT_1$ is not enabled so that the accept solenoid $L_3$ is not energized. Thus, again, this coin will be deflected into the return or rejection chamber 50 and not result in an actuation of the gaming or vending device controlled by the coin acceptor mechanism.

Lastly, if a coin having a high ferrite composition is deposited within the coin slot 10, it will be seen that the content coin detector 86 will generate a negative going pulse on conductor 82 whose magnitude substantially exceeds the 220 to 280 mv range set. Under these conditions, as will be appreciated by those or ordinary skill in the art, the normal output conditions of the comparators $M_1$ and $M_2$ will both be changed. When the output state of the comparator $M_1$ shifts from high to low, the light-emitting diode 26 will again be enabled so that the reflectivity of the coin inserted is again tested in precisely the same manner described above. However, when the output of the comparator $M_2$ is shifted from its normal low state to a high state to forward bias the diode $D_3$, the comparator $M_4$ will shift to a high state and this state will be maintained for an interval of approximately 200 milliseconds. This means that regardless of whether or not the output conditions of the comparators $M_5$ and $M_3$ are changed as a result of the reflectivity test, the opto-isolator $OT_1$ cannot be enabled since the cathode thereof is clamped at a high level. Furthermore, this high level at the output of the comparator $M_4$ will persist for an interval of approximately 200 milliseconds, which is substantially longer than the 80 millisecond interval associated with the output of the comparator $M_3$ going low. Hence, under all conditions, a coin having a high ferrite content capable of generating a negative going pulse from the content coin detector 86 exceeding the upper threshold range will result in the accept solenoid $L_3$ not being enabled. Therefore, this coin too will be conveyed to the rejection or return chamber 50 since the pivotable plate 60 is not shifted.

Those of ordinary skill in the art will readily appreciate that the instant invention admits of adjustment through the use of the variable resistors $VR_1$ and $VR_2$ so that a coin or token of any particular denomination, content and reflectivity characteristic may be readily accommodated. Furthermore, it will be appreciated that while an electronic eddy current coin detector of the type disclosed in U.S. Pat. No. 4,354,587 has been disclosed as employed within the instant invention, other known forms of coin detectors may be employed, regardless of whether or not the analysis conducted is implemented on an electronic, magnetic or mechanical basis. Hence, those of ordinary skill in the art will appreciate that the reflectivity test associated with the present invention may be employed in connection with essentially any of such known prior art coin acceptors.

While the invention has been described in connection with a preferred exemplary embodiment thereof, it will be understood that many modifications will be readily apparent to those of ordinary skill in the art and that this application is intended to cover any adaptations or variations thereof. Therefore, it is manifestly intended that this invention be only limited by the claims and the equivalents thereof.

What is claimed is:

1. Coin detector apparatus comprising:

means for measuring the response of a coin to be tested to an oscillating electromagnetic field so as to provide an output indicative of a measured value related to the mass and conductivity of said coin;

means for exposing said coin to be tested to radiation;

means in light communication with said coin to be tested for providing a signal representative of the average reflectivity of the coin;

means for comparing said signal to a predetermined level; and means responsive to said measured value exceeding a selected threshold and said signal exceeding said predetermined level for providing an indication that said coin is genuine.

2. The coin detector apparatus according to claim 1 wherein said means for exposing includes light-emitting diode means.

3. The coin detector apparatus according to claim 2 wherein said means for measuring includes comparator means, said comparator means having a first input connected to receive said output indicative of a measured value and a second input connected to means for applying a reference level, said comparator means having an output connected to said light-emitting diode means and enabling said light-emitting diode means only when said output connected to said first input thereof exceeds a predetermined value in relation to said reference level.

4. The coin detector apparatus according to claim 1 additionally comprising:

comparison means for comparing said output indicative of a measured value to an upper threshold condition and for providing another output whenever said upper threshold condition is exceeded; and means responsive to said another output for inhibiting said indication that said coin is genuine.

5. The coin detector apparatus according to claim 1 wherein said means in light communication with said coin to be tested comprises phototransistor means, said phototransistor means being normally biased to an off condition until such time as said coin to be tested is exposed to radiation and being connected to means for slowing the response thereof to compensate for effects of engravings on said coin.

6. The coin detector apparatus according to claim 1 wherein said means for comparing said signal to a predetermined level comprises comparison means, said comparison means having one input means for receiving said signal representative of radiation reflected from said coin and another input means for receiving said predetermined level.

7. The coin detector apparatus according to claim 6 wherein said another input means is temperature compensated.

8. The coin detector apparatus according to claim 7 wherein said means for exposing includes light-emitting diode means.

9. The coin detector apparatus according to claim 8 wherein said means for measuring includes comparator means, said comparator means having a first input connected to receive said output indicative of a measured value and a second input connected to means for applying a reference level, said comparator means having an output connected to said light-emitting diode means and enabling said light-emitting diode means only when said output connected to said first input thereof exceeds a predetermined value in relation to said reference level.

10. The coin detector apparatus according to claim 9 additionally comprising:

comparison means for comparing said output indicative of a measured value to an upper threshold condition and for providing another output whenever said upper threshold condition is exceeded; and means responsive to said another output for inhibiting said indication that said coin is genuine.

11. The coin detector apparatus according to claim 10 wherein said means in light communication with said coin to be tested comprises phototransistor means, said phototransistor means being normally biased to an off condition until such time as said coin to be tested is exposed to radiation and being connected to means for slowing the response thereof to compensate for effects of engravings on said coin.

12. Coin detector apparatus comprising:

measurement means for measuring a parameter indicative of material content of a coin to be tested and providing an output indicative of a measured value;

exposure means responsive to the output of said measurement means for exposing said coin to be tested to radiation only when the value of said parameter measured by said measurement means exceeds a selected threshold;

means in light communication with said coin to be tested for providing a signal representative of radiation reflected from said coin; and means for comparing said signal to a predetermined level and providing an indication that said coin is genuine if said signal exceeds said predetermined level, said means in light communication being operative to produce said signal so that said signal is representative of the average reflectivity of the coin.

* * * * *